US007628623B2

(12) United States Patent
Combs et al.

(10) Patent No.: US 7,628,623 B2
(45) Date of Patent: Dec. 8, 2009

(54) MEMORY CARD BEZEL FOR AN APPARATUS

(75) Inventors: James Lee Combs, Lexington, KY (US); Gary Lee Noe, Lexington, KY (US); William Henry Reed, Lexington, KY (US)

(73) Assignee: Lexmark International Inc., Lexington, KY (US)

( * ) Notice: Subject to any disclaimer, the term of this patent is extended or adjusted under 35 U.S.C. 154(b) by 666 days.

(21) Appl. No.: 11/095,109

(22) Filed: Mar. 31, 2005

(65) Prior Publication Data

US 2006/0223381 A1 Oct. 5, 2006

(51) Int. Cl.
*H01R 13/62* (2006.01)

(52) U.S. Cl. ..... 439/135; 439/630; 439/677

(58) Field of Classification Search ..... 439/677, 439/633, 630, 135, 680, 681; 361/737, 752; 235/492

See application file for complete search history.

(56) References Cited

U.S. PATENT DOCUMENTS 5,199,888 A * 4/1993 Condra et al. ..... 439/142
5,547,272 A 8/1996 Paterson et al.
5,630,167 A 5/1997 Hosokawa
5,752,857 A 5/1998 Knights
5,818,029 A 10/1998 Thomson
6,457,647 B1 10/2002 Kurihashi et al.
6,524,137 B1 2/2003 Liu et al.
6,554,378 B1 4/2003 Foslien et al.
6,558,201 B1 5/2003 Begley et al.
6,607,405 B2 8/2003 Nishimura
6,608,766 B2 8/2003 Wortman et al.
6,645,000 B2 * 11/2003 Sato et al. ..... 439/490
6,671,764 B2 12/2003 Martin
6,738,259 B2 5/2004 Le et al.
6,751,694 B2 6/2004 Liu et al.
2001/0039129 A1 * 11/2001 Nishimura ..... 439/630

* cited by examiner

*Primary Examiner*—Felix O Figueroa
(74) *Attorney, Agent, or Firm*—Taylor & Aust, PC

(57) ABSTRACT

An apparatus includes a multi-format memory card drive having a multi-format memory card slot configured to receive any of a plurality of memory cards having a corresponding plurality of memory card formats. At least one of the plurality of memory cards has a memory card format that is different from another memory card format of the plurality of memory card formats. A bezel is configured for installation over the multi-format memory card slot. The bezel is configured to select a subset of the plurality of memory card formats that can be received by the multi-format memory card slot of the multi-format memory card drive.

20 Claims, 5 Drawing Sheets

MEMORY CARD BEZEL FOR AN APPARATUS

BACKGROUND OF THE INVENTION

1. Field of the Invention

The present invention relates to an apparatus, and, more particularly, to a memory card bezel for an apparatus, such as an imaging apparatus.

2. Description of the Related Art

Images taken by digital cameras are typically stored in a removable memory card associated with the camera. The removable memory card then may be loaded into a memory card reader, which is also referred to in the art as a memory card drive. The memory card drive may be formed integral with the imaging apparatus, such as a computer or printer, or may be a separate device which is configured to be attached to the imaging apparatus.

Referring to FIG. 1, examples of such removable memory cards include the Memory Stick™ (MS) card 10 developed by Sony Corporation, the Smart Media™ (SM) card 12, the Secure Digital (SD) card 14, the MultiMedia Card (MMC) 16 jointly developed by SanDisk Corporation and Siemens AG/Infineon Technologies AG, and the xD card 18 that is used, for example, with digital cameras available from Olympus.

Many of the various types of removable memory cards have a unique format, e.g., unique electrical configurations and mechanical dimensions. As used herein, reference to a memory card width (W) and height (H) refers to the dimensions of the card which affect its ability to be received in a card slot of the memory card drive. Accordingly, in this regard the length (L) of the memory card typically is not a critical dimension. In terms of width and height, for example, MS card 10 has a size of approximately 21.6 mm×2.85 mm and has either four conductive pins or ten conductive pins; SM card 12 has a size of approximately 37.2 mm×0.95 mm and has 22 conductive pins; SD card 14 has a size of approximately 24.2 mm×2.1 mm; MMC 16 has a size of approximately 24.2 mm×1.40 mm; and xD card 18 has a size of approximately 25.2 mm×1.75 mm.

As shown in FIG. 2, a multi-format memory card drive 20 is available that accommodates multiple types of memory cards, such as for example, any of MS card 10, SM card 12, SD card 14, MMC 16, and xD card 18. Multi-format memory card drive 20 includes a housing 22 that defines a single multi-format memory card slot 24 to receive the different types of removable memory cards. Multi-format memory card slot 24 includes a central region 26 of a first height and outer regions 28*a*, 28*b* of a second height. A plurality of electrically conductive contact areas 30 are disposed within the single slot for reading each of the types of cards that may be inserted into the single multi-format memory card slot 24.

While multi-format memory card drive 20, which can accommodate a plurality of types of removable memory cards, provides an overall convenience and a cost savings to a user by reducing the number of memory card drives that the user may need to purchase in order to read multiple card types, it is possible for a user to damage the mechanical and/or electrical features of the card and/or the memory card drive if the card is improperly inserted into multi-format memory card drive 20.

SUMMARY OF THE INVENTION

The present invention provides a device that permits a user to customize the card slot opening of the multi-format memory card drive to correspond to a particular type of memory card that is used by the user.

The invention, in one form thereof, is directed to an apparatus including a multi-format memory card drive. The multi-format memory card drive has a multi-format memory card slot configured to receive any of a plurality of memory cards having a corresponding plurality of memory card formats. At least one of the plurality of memory cards has a memory card format that is different from another memory card format of the plurality of memory card formats. A bezel is configured for installation over the multi-format memory card slot. The bezel is configured to select a subset of the plurality of memory card formats that can be received by the multi-format memory card slot of the multi-format memory card drive.

The present invention, in another form thereof, is directed to a method to customize a multi-format memory card drive installed in an apparatus. The method includes determining a type of memory card desired to be inserted in a multi-format memory card slot of the multi-format memory card drive; selecting a bezel having a bezel slot corresponding to a width and a height of the memory card; and installing the bezel over the multi-format memory card slot.

The invention, in another form thereof, is directed to a kit for use with an apparatus having a multi-format memory card slot configured to receive a plurality of memory cards having a corresponding plurality of memory card formats, at least one of the plurality of memory cards having a memory card format that is different from another memory card format of the plurality of memory card formats. The kit includes a plurality of bezels configured for installation over the multi-format memory card slot. Each bezel of the plurality of bezels is configured to accommodate a particular memory card format of the plurality of memory card formats to select the particular memory card format of a memory card that is to be inserted into the multi-format memory card slot.

BRIEF DESCRIPTION OF THE DRAWINGS

The above-mentioned and other features and advantages of this invention, and the manner of attaining them, will become more apparent, and the invention will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any manner.

DETAILED DESCRIPTION OF THE INVENTION

Figure 3:
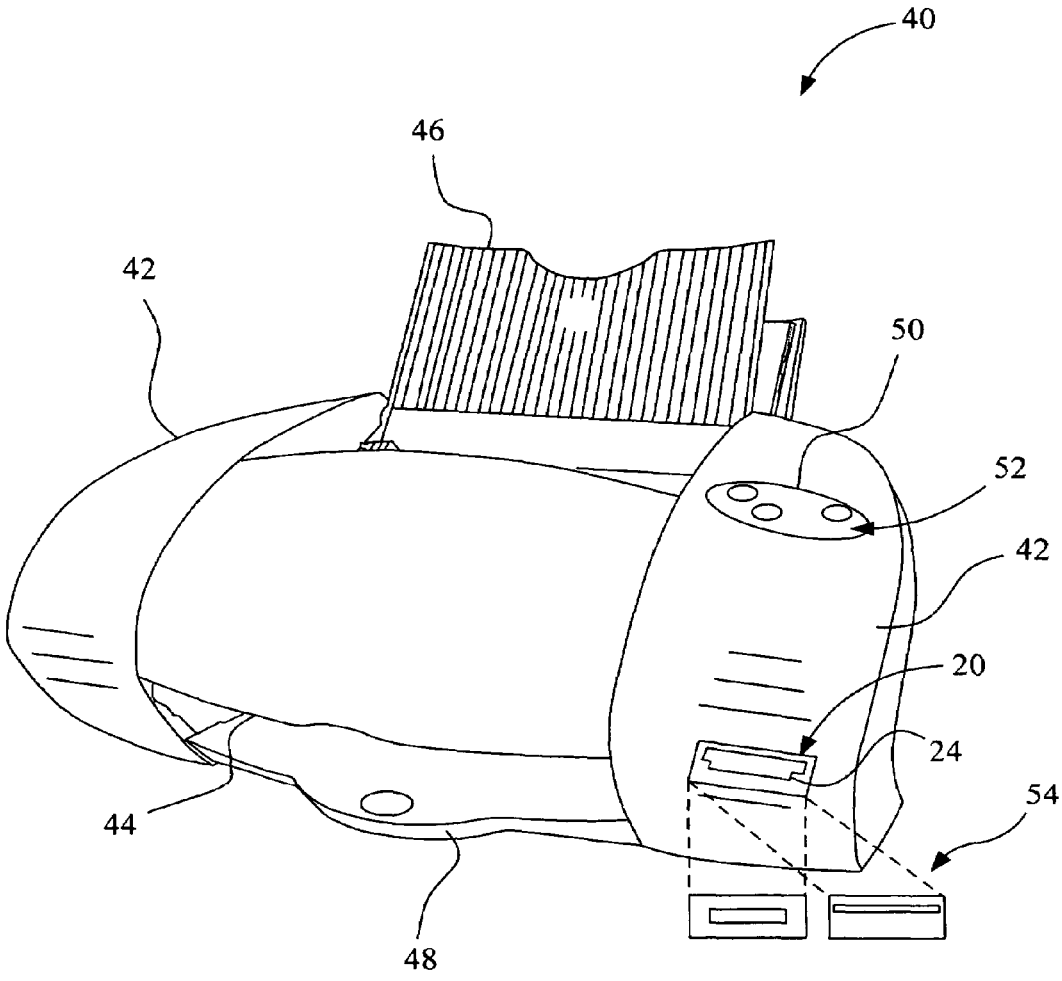
FIG. 3 is a perspective view of an imaging apparatus incorporating the multi-format memory card drive of FIG. 2, and showing two exemplary replaceable bezels configured in accordance with the present invention.
Figure 4:
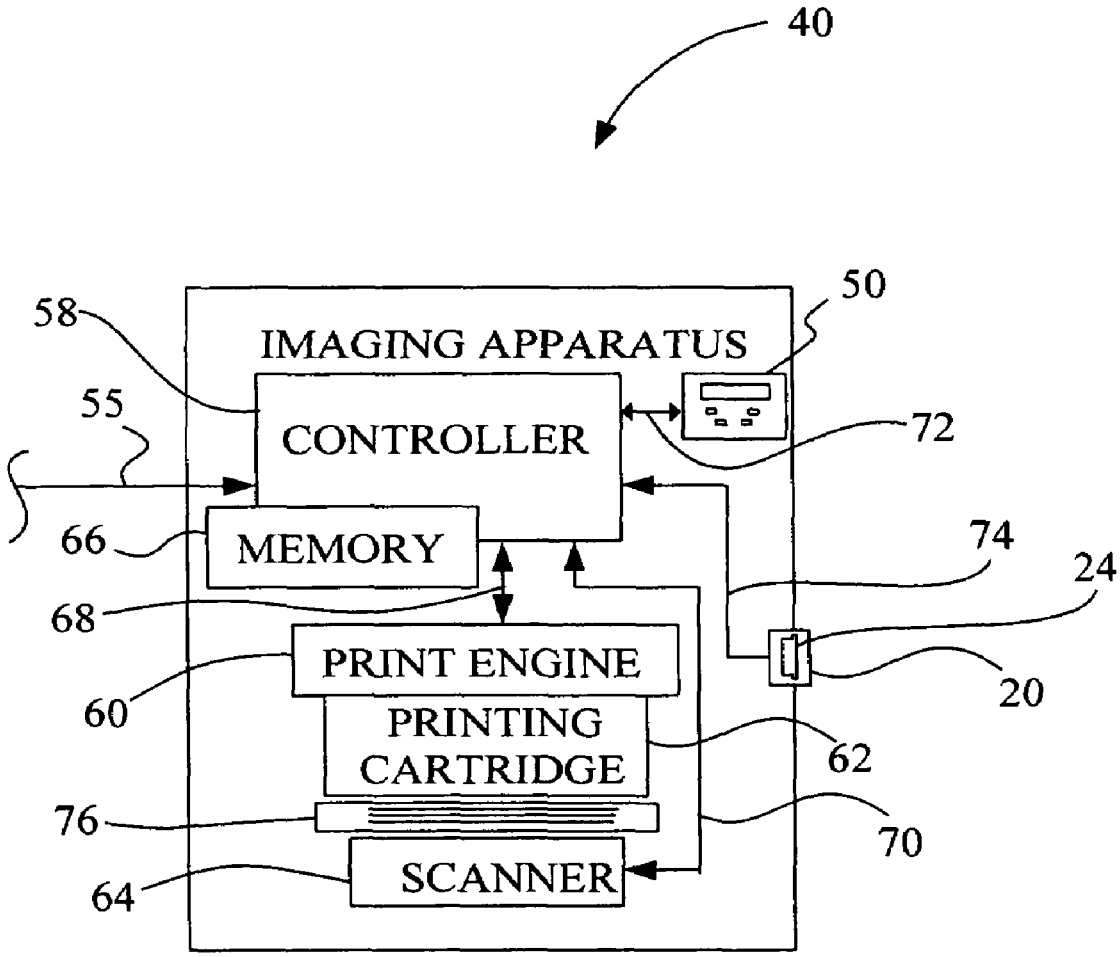
FIG. 4 is a diagrammatic depiction of the imaging apparatus of FIG. 3.
Figure 5:
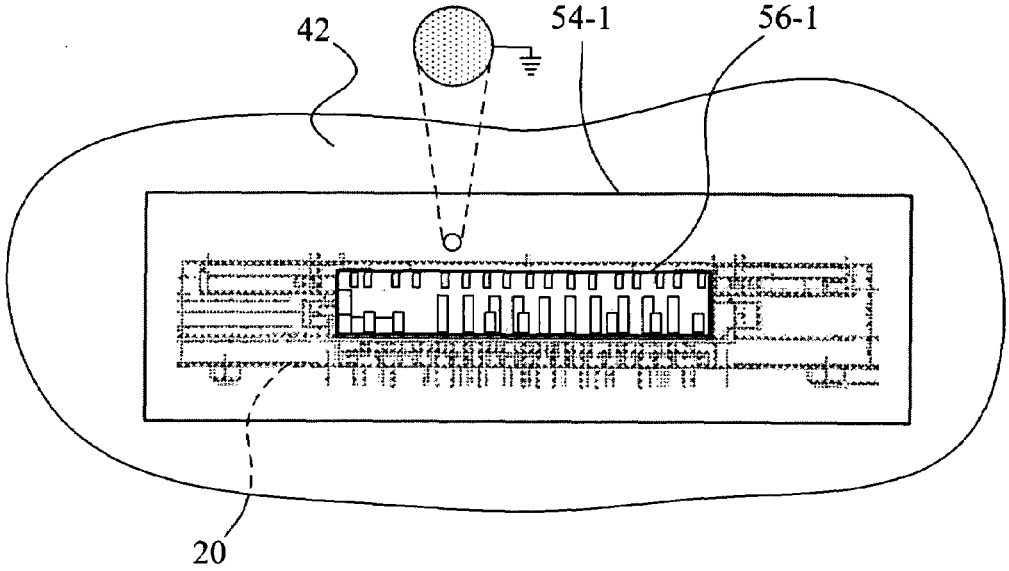
FIG. 5 is a plan view of an exemplary MS bezel of the present invention.
Figure 6:
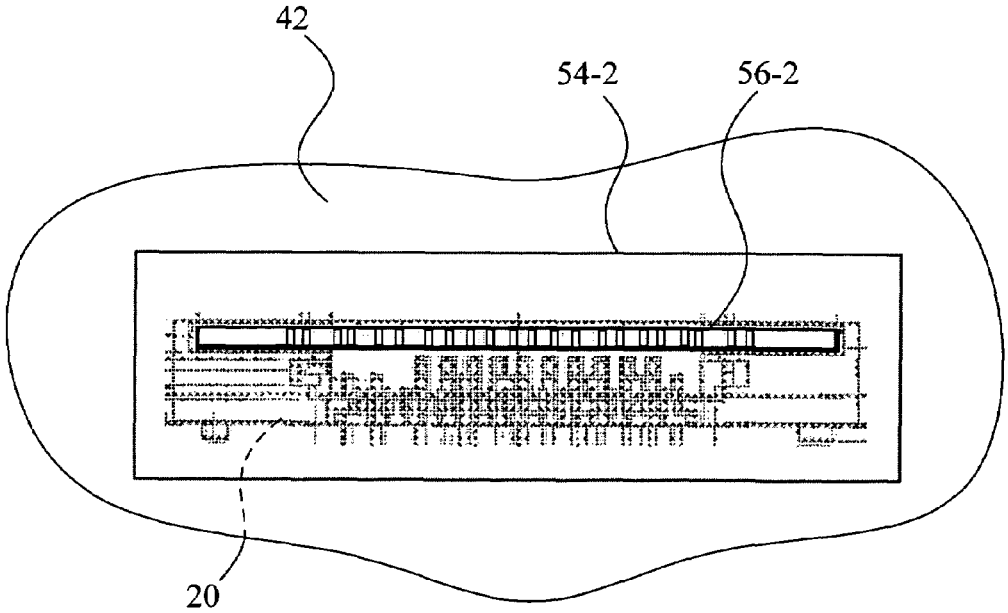
FIG. 6 is a plan view of an exemplary SM bezel of the present invention.
Figure 7:
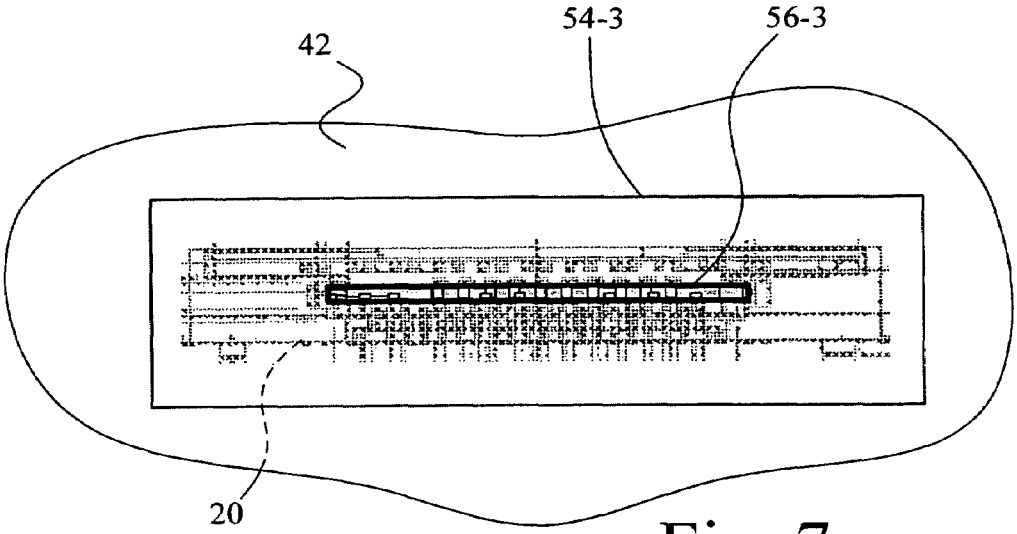
FIG. 7 is a plan view of an exemplary SD/MMC bezel of the present invention.
Figure 8:
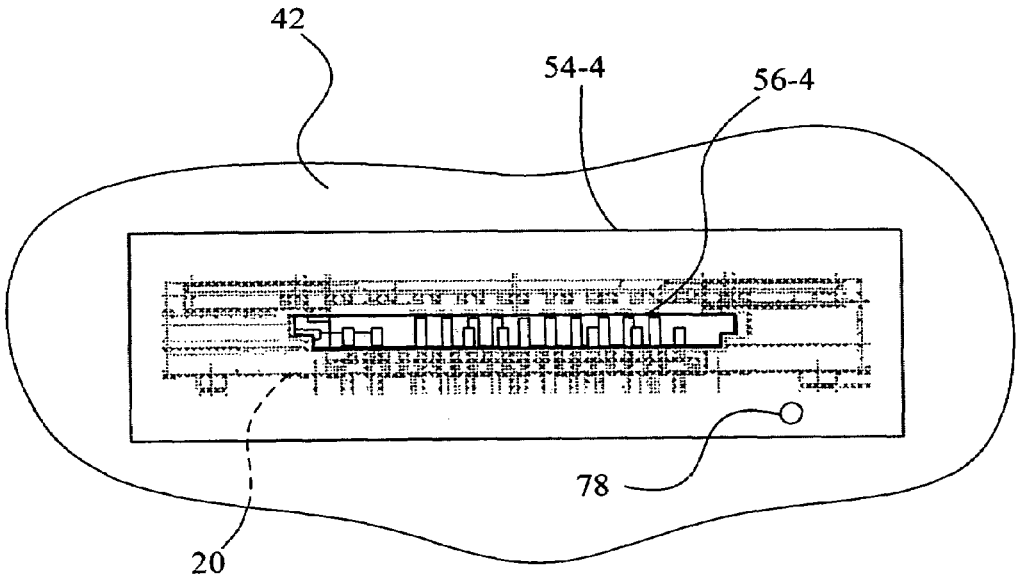
FIG. 8 is a plan view of an exemplary xD bezel of the present invention.

Referring now to the drawings, and particularly to FIG. 3, there is shown a perspective view of an imaging apparatus 40 embodying the present invention. FIG. 4 is a diagrammatic depiction of imaging apparatus 40.

Imaging apparatus 40 may be, for example, a conventional printer, or a multi-function device (MFD), such as for example, a standalone unit that has faxing and copying capability, in addition to printing.

Imaging apparatus 40 includes a housing 42, e.g., cover, and a door 44 mounted to housing 42. Imaging apparatus 40 also includes a media source tray 46 and a media exit tray 48. Mounted to housing 42 is a user interface 50 including a plurality of control buttons 52. Accessible to an exterior of imaging apparatus 40 through housing 42 is multi-format memory card drive 20. A plurality of bezels 54 is provided, from which one of the bezels is selected and attached housing 42.

Referring to FIG. 4, imaging apparatus 40 may be connected to a host, such as a computer (not shown), via a communications link 55. As used herein, the term "communications link" is used to generally refer to structure which facilitates electronic communication between two or more components, and may operate using wired or wireless technology.

Imaging apparatus 40, as an MFD, includes a controller 58, a print engine 60, a printing cartridge 62, a scanner 64, and user interface 50. Controller 58 includes a processor unit and associated memory 66, and may be formed as one or more Application Specific Integrated Circuits (ASIC). Alternatively, memory 66 may be in the form of a separate electronic memory, a hard drive, a CD drive, or any memory device convenient for use with controller 58. Controller 58 may be a printer controller, a scanner controller, or may be a combined printer and scanner controller. Controller 58 communicates with print engine 60 via a communications link 68. Controller 58 communicates with scanner 64 via a communications link 70. User interface 50 is communicatively coupled to controller 58 via a communications link 72. Multi-format memory card drive 20 is communicatively coupled to controller 58 via a communications link 74.

Controller 58 serves to process print data and to operate print engine 60 during printing, as well at to operate scanner 64 and process data obtained via scanner 64. In addition, controller 58 serves to process data that is read from a memory card by multi-format memory card drive 20. Such data maybe supplied, for example, to memory 66 for storage, or to print engine 60 for printing. Such data may include for example, digital photographs, graphics or text data. Print engine 60 may be, for example, an ink jet print engine, a color electrophotographic print engine or thermal transfer engine, configured for forming an image on a substrate 76, such as a sheet of paper, transparency or fabric.

Figure 1:
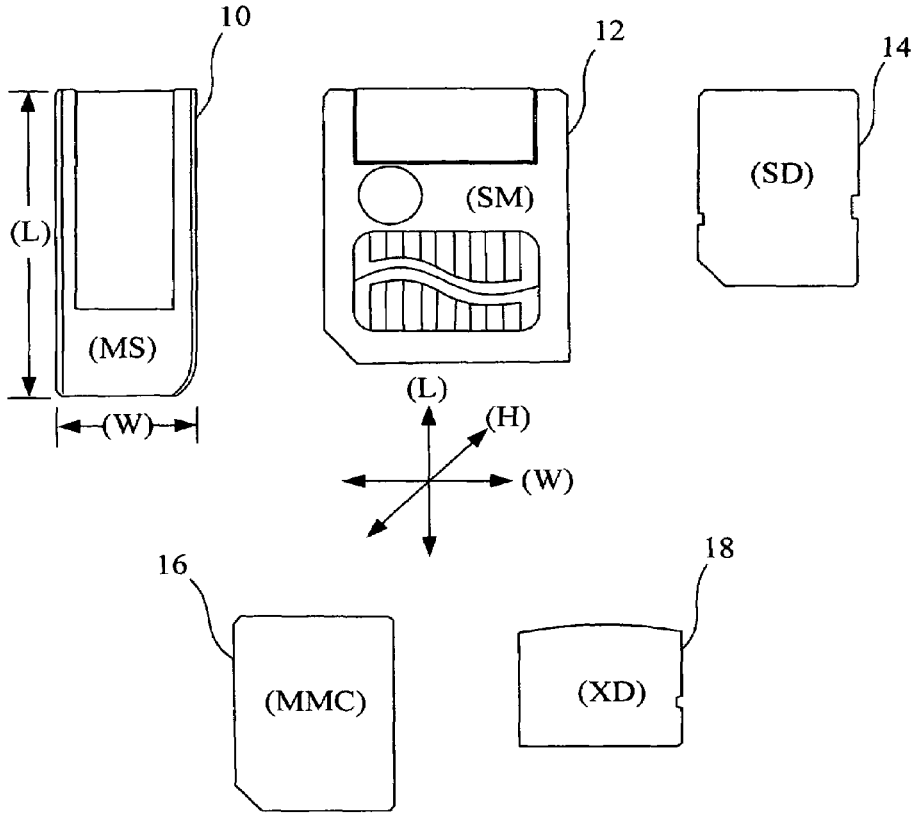
PRIOR ART Fig. 1
FIG. 1, designated as prior art, is a plan view of several types of common removable memory cards.
Figure 2:
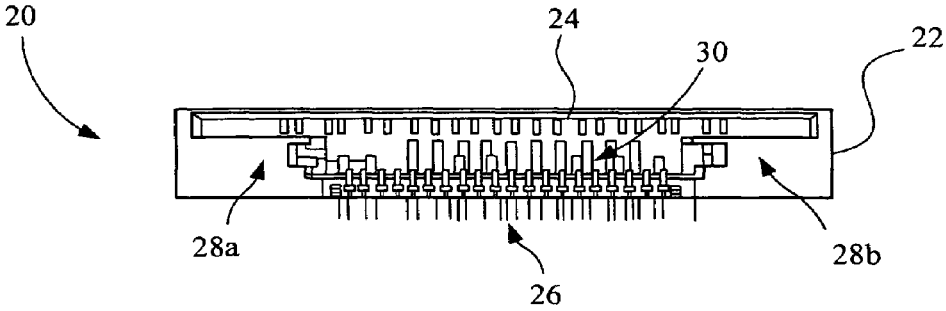
PRIOR ART Fig. 2
FIG. 2, designated as prior art, is a front view of an exemplary multi-format memory card drive.

Referring again to FIG. 1, each bezel of the plurality of bezels 54 is configured in accordance with the present invention for installation over multi-format memory card slot 24 of multi-format memory card drive 20 to restrict access thereto. Each of the plurality of bezels 54 may be individually mounted to housing 42 by sliding the bezel, e.g., vertically, into position along a guide slot formed in housing 42. Alternatively, each bezel may be mounted to housing 42 via fasteners, such as clips, snap features, or screws.

The plurality of bezels 54 are designed to shield the unused electrical contacts of electrically conductive contact areas 30 in multi-format memory card drive 20, with the benefit of reducing or eliminating undesired electrostatic discharge between the memory card and imaging apparatus 40. Further to this purpose of reducing electrostatic problems, each of the plurality of bezels 54 may be metallized, e.g., coated with a conductive substance, and grounded to provide a safe path for electrostatic discharge before the memory card reaches any of the electrical contacts of electrically conductive contact areas 30 in multi-format memory card drive 20.

FIGS. 5-8 show four exemplary bezels: MS bezel 54-1, SM bezel 54-2, SD/MMC bezel 54-3 and xD bezel 54-4. Each bezel 54-1, 54-2, 54-3, 54-4 of the plurality of bezels 54 includes a respective bezel slot 56-1, 56-2, 56-3, 56-4, and is configured to select a subset of the plurality of memory card formats that can be received by multi-format memory card slot 24.

As a first example, the subset may accommodate only a particular one the plurality of memory card formats to select the particular memory card format of a memory card that can be received by the multi-format memory card slot 24. This is the case, for example, with MS bezel 54-1, SM bezel 54-2 and xD bezel 54-4. As another example, the subset may include two or more, but less than all, of the plurality of memory card formats to select a group, e.g., a family, of memory card formats that can be received by multi-format memory card slot 24. This is the case, for example, with SD/MMC bezel 54-3.

Bezel slot 56-1 of MS bezel 54-1 is configured to correspond to, e.g., to be slightly larger than, the width and height dimensions of MS card 10. Bezel slot 56-1 may be beveled at its outer edge to aid in the insertion of MS card 10. In addition to providing a mechanical restriction to accessing multi-format memory card slot 24 of multi-format memory card drive 20, MS bezel 54-1 also restricts access to the undesired areas of electrically conductive contact areas 30, while permitting access to the desired areas of electrically conductive contact areas 30 associated with MS card 10.

Bezel slot 56-2 of SM bezel 54-2 is configured to correspond to, e.g., to be slightly larger than, the width and height dimensions of SM card 12. Bezel slot 56-2 may be beveled at its outer edge to aid in the insertion of SM card 12. In addition to providing a mechanical restriction to accessing multi-format memory card slot 24 of multi-format memory card drive 20, SM bezel 54-2 also restricts access to the undesired areas of electrically conductive contact areas 30, while permitting access to the desired areas of electrically conductive contact areas 30 associated with SM card 12.

Bezel slot 56-3 of SD/MMC bezel 54-3 is configured to correspond to, e.g., to be slightly larger than, the width and height dimensions of SD card 14 and MMC 16. Bezel slot 56-3 may be beveled at its outer edge to aid in the insertion of SD card 14 or MMC 16. In addition to providing a mechanical restriction to accessing multi-format memory card slot 24 of multi-format memory card drive 20, SD/MMC bezel 54-3 also restricts access to the undesired areas of electrically conductive contact areas 30, while permitting access to the desired areas of electrically conductive contact areas 30 associated with SD card 14 and MMC 16.

Bezel slot 56-4 of xD bezel 54-4 is configured to correspond to, e.g., to be slightly larger than, the width and height dimensions of xD card 18. Bezel slot 56-4 may be beveled at its outer edge to aid in the insertion of xD card 18. In addition to providing a mechanical restriction to accessing multi-format memory card slot 24 of multi-format memory card drive 20, xD bezel 54-4 also restricts access to the undesired areas of electrically conductive contact areas 30, while permitting access to the desired areas of electrically conductive contact areas 30 associated with xD card 18.

Multi-format memory card drives, such as multi-format memory card drive 20, may have an light, e.g., an LED, that is illuminated to indicate the drive is active. In one embodiment of the invention, the plurality of bezels 54 (see, e.g., xD bezel 54-4 of FIG. 8) may include a feature 78, such as for example a window or optical light pipe, that facilitates a display of the indicator light of multi-format memory card drive 20.

When shipped to a retail outlet, an apparatus, such as imaging apparatus 40, may have installed a standard non-restrictive multi-format bezel that provides access to all card positions within multi-format memory card drive 20. A kit may be prepared for use with imaging apparatus 40 that includes, for example, one or more of the plurality of bezels 54 configured for installation over multi-format memory card slot 24 of multi-format memory card drive 20. The kit may be provided with imaging apparatus 40, or as an after market option for use with imaging apparatus 40. The user may then choose to remove the originally installed standard non-restrictive multi-format bezel, and replace it with one of the plurality of bezels from the kit in accordance with the type on memory card that the user uses.

Thus, the present invention provides a method to customize a multi-format memory card drive 20 installed in imaging apparatus 40. The user determines a type of memory card, such as for example, one of MS card 10, SM card 12, SD card 14, MMC 16, and xD card 18, that the user desires to be inserted in multi-format memory card slot 24 of multi-format memory card drive 20, and typically to the exclusion of other types of memory cards. The user selects a bezel, such as for example, one of MS bezel 54-1, SM bezel 54-2, SD/MMC bezel 54-3, and xD bezel 54-4, having a bezel slot corresponding to a width and a height of the memory card to be inserted in multi-format memory card slot 24 of multi-format memory card drive 20. The user removes, if present, any installed standard non-restrictive multi-format bezel that provides full access to all card positions in multi-format memory card slot 24 of multi-format memory card drive 20. Then, the user installs the selected bezel over multi-format memory card slot 24 of multi-format memory card drive 20.

While this invention has been described with respect to exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus, comprising:

a multi-format memory card drive having a multi-format memory card slot configured to receive any one of a plurality of memory cards having a corresponding plurality of memory card formats, at least one of said plurality of memory cards having a memory card format that is different from another memory card format of said plurality of memory card formats; and a first bezel configured for installation over said multi-format memory card slot, said first bezel being configured to select a subset of said plurality of memory card formats that can be received by said multi-format memory card slot of said multi-format memory card drive.

2. The apparatus of claim 1, wherein said subset is a particular one of said plurality of memory card formats.

3. The apparatus of claim 1, wherein said subset is a group selected from said plurality of memory card formats that can be received by said multi-format memory card slot.

4. The apparatus of claim 1, wherein said first bezel prevents an insertion of at least one of said plurality of memory cards into said multi-format memory card slot.

5. The apparatus of claim 1, wherein said first bezel is configured to accommodate a first memory card format of said plurality of memory card formats to select said first memory card format of a memory card that can be received by said multi-format memory card slot.

6. The apparatus of claim 1, further comprising a second bezel being configured to accommodate a second memory card format of said plurality of memory card formats to select said second memory card format of a memory card that can be received by said multi-format memory card slot, and wherein said second bezel prevents an insertion of memory cards having said first memory card format.

7. The apparatus of claim 1, said apparatus being an imaging apparatus including a print engine.

8. The apparatus of claim 1, said apparatus further comprising a housing, with access to said multi-format memory card drive being provided by said housing, said first bezel being attached to said housing.

9. The apparatus of claim 8, wherein said first bezel is slidably received by said housing.

10. The apparatus of claim 1, said first bezel including a feature for facilitating a display of an indicator light of said multi-format memory card drive.

11. The apparatus of claim 1, said first bezel being coated with a conductive substance and grounded to provide a path for electrostatic discharge.

12. A method to customize a multi-format memory card drive installed in an apparatus:

determining a type of memory card desired to be inserted in a multi-format memory card slot of said multi-format memory card drive;

selecting a bezel having a bezel slot corresponding to a width and a height of said memory card; and installing said bezel over said multi-format memory card slot.

13. The method of claim 12, said bezel being one of a plurality of bezels.

14. The method of claim 12, wherein prior to said installing step, performing the step of removing an installed standard non-restrictive multi-format bezel that provides full access to all card positions in said multi-format memory card slot.

15. A kit for use with an apparatus having a multi-format memory card slot configured to receive a plurality of memory cards having a corresponding plurality of memory card formats, at least one of said plurality of memory cards having a memory card format that is different from another memory card format of said plurality of memory card formats, comprising a plurality of bezels configured for installation over said multi-format memory card slot, each bezel of said plurality of bezels being configured to accommodate a particular memory card format of said plurality of memory card formats to select said particular memory card format of a memory card that is to be inserted into said multi-format memory card slot.

16. The kit of claim 15, wherein a first bezel of said plurality of bezels prevents an insertion of at least one of said plurality of memory cards into said multi-format memory card slot.

17. The kit of claim 15, wherein each bezel of said plurality of bezels is coated with a conductive substance to provide a ground path for electrostatic discharge.

18. The apparatus of claim 1, wherein said first bezel has a bezel slot configured to provide a mechanical restriction to select said subset of said plurality of memory card formats that can be received by said multi-format memory card slot of said multi-format memory card drive.

19. The apparatus of claim 6, wherein said second bezel has a bezel slot configured to provide a mechanical restriction that prevents an insertion of memory cards having said first memory card format.

20. The kit of claim 15, wherein each of said plurality of bezels includes a respective bezel slot configured to provide a mechanical restriction to select said particular memory card format of a corresponding memory card that is to be inserted into said multi-format memory card slot.

* * * * *